United States Patent [19]

Kuhn

[11] Patent Number: 4,974,270

[45] **Date of Patent: * Dec. 4, 1990**

[54] DISPOSABLE BED PAN

[75] Inventor: George C. Kuhn, East Rochester, N.Y.

[73] Assignee: Try Sheet Inc., East Rochester, N.Y.

[ * ] Notice: The portion of the term of this patent subsequent to Sep. 1, 2004 has been disclaimed.

[21] Appl. No.: 329,448

[22] Filed: Mar. 28, 1989

Related U.S. Application Data

[60] Division of Ser. No. 90,970, Aug. 31, 1987, and a continuation-in-part of Ser. No. 935,016, Nov. 28, 1986, Pat. No. 4,689,842.

[51] Int. Cl.[5] ..... A61G 7/02

[52] U.S. Cl. ..... 5/90; 5/463; 4/451

[58] Field of Search ..... 4/144.2, 450, 451, 452, 4/456, 479, 480, 484; 5/61, 81 R, 81 B, 82 R, 83, 84, 39, 90, 461, 463

[56] References Cited

U.S. PATENT DOCUMENTS

| | | | |
|---|---|---|---|
| 346,309 | 7/1886 | O'Brien | 4/456 X |
| 1,998,061 | 4/1935 | Wachs | 5/90 X |
| 2,886,827 | 5/1959 | Washington | 4/456 |
| 2,932,831 | 4/1960 | Keathley, Sr. et al. | 5/90 X |
| 3,115,644 | 12/1963 | Bloodworth | 4/452 |
| 3,495,278 | 2/1970 | Peters | 4/144.2 X |
| 3,729,749 | 5/1973 | Rosecrans | 4/452 |
| 4,101,991 | 7/1978 | Sandonato | 5/90 |
| 4,689,842 | 9/1987 | Kuhn | 5/90 X |
| 4,838,742 | 5/1989 | Kuhn | 5/90 |

FOREIGN PATENT DOCUMENTS

| | | | |
|---|---|---|---|
| 908451 | 10/1962 | United Kingdom | 4/452 |
| 2108381 | 5/1983 | United Kingdom | 4/451 |

*Primary Examiner*—Michael F. Trettel

*Attorney, Agent, or Firm*—Robert M. Phipps

[57] ABSTRACT

A bed pan for use in patient care has a disposable plastic liner waste collector suspended from an open frame whose exterior dimensions encompass the plastic liner and retainers for keeping the plastic liner to the frame. The bed pan is advantageously used with a patient platform or patient motivation device, both of which provide a passage way for aliding the bed pan under the patient's excretory organs with out discomfort to the patient.

6 Claims, 3 Drawing Sheets

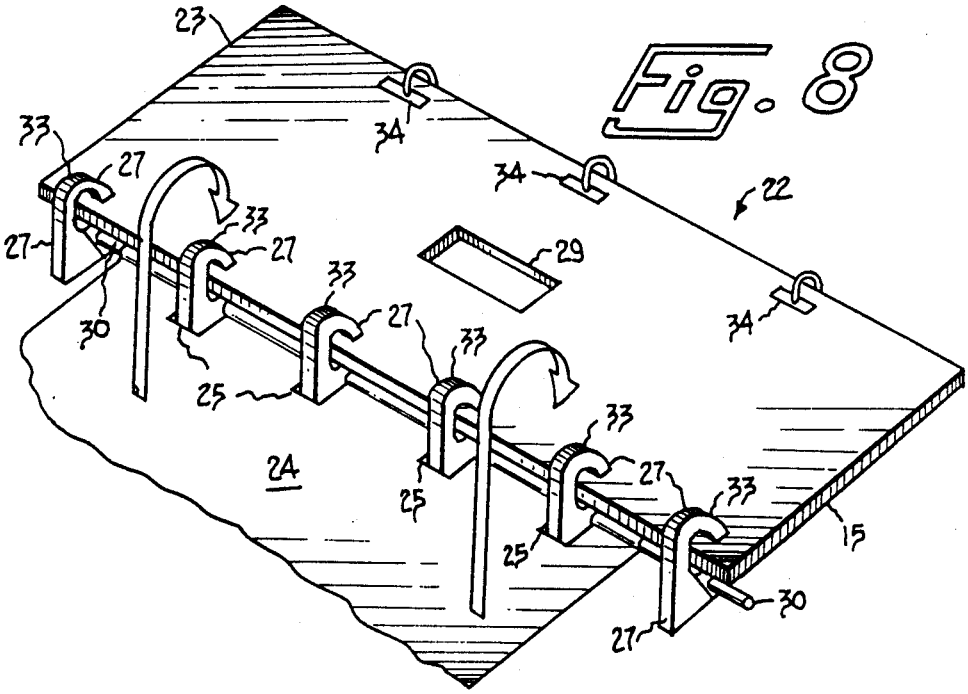
Fig. 8
Fig. 6
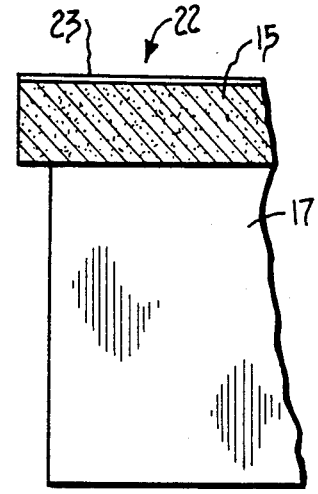
Fig. 7
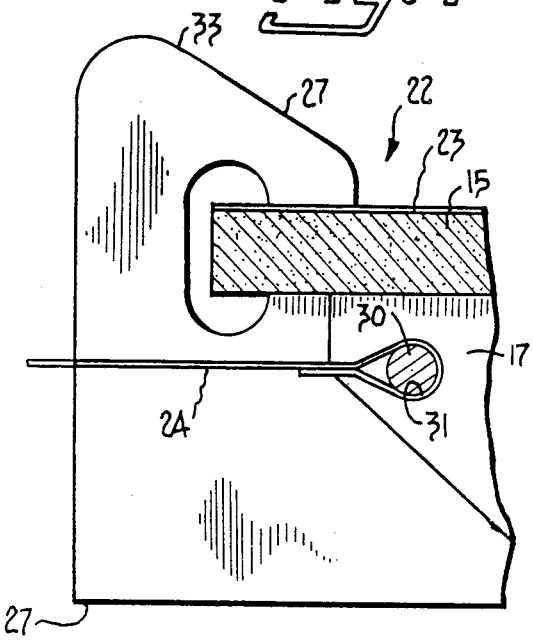

DISPOSABLE BED PAN

RELATED APPLICATIONS

This is a division of application Ser. No. 7/090,970 filed Aug. 31, 1987, now U.S. Pat. No. 4,833,742 which is a continuation-in-part of application Ser. No. 935,016 filed Nov. 28, 1986, now U.S. Pat. No. 4,689,842.

BACKGROUND

1. Field of the Invention

This invention relates to the caring for the excretory functions of bedridden patients.

2. Description of the Prior Art

The care of a bedridden patient over the years has been unsatisfactory with respect to on going body functions such as the excretory organs. It has reached the point that jokes and sad stories about patients' use of bedpans are legion. In U.S. Pat. No. 266,167 (1882) A. Leslie disclosed an invalid hammock which was fastened at the foot of the bed, passed over the very high head board and down the back side of the head board to a crank operated drum. By this means slack in the hammock could be reduced, thus suspending the patient or slack let out to lower the patient. The patient could be lowered down on to the bed's' mattress. To enable the patient to use the bed pan without leaving the hammock, an opening, where the buttocks usually come, was provided. The opening could be covered with a flap. As is commonly known, this concept was not adopted as practical.

J. A. Devore, et al in U.S. Pat. No. 778,570 (1904) disclosed an invalid bed in which a stretcher was installed on a telescoping frame. The stretcher could be raised from the mattress, by a crank mechanism at the foot of the bed, a sufficient distance from the mattress to insert a vessel, i.e., bed pan and the like, under the hole in the stretcher. It was intended that the patient be continuously on the stretcher. Preferably, the stretcher was made of waterproof material. Again, this device as not adopted by the public as a practical means of caring for the bedridden patient. One can readily imagine the bedridden patient's comfort on such a device.

F. T. Ridley, in U.S. Pat. No. 1,981,666 (1934) disclosed an inflatable device for use as a bed lift and to support patients in conjunction with, among other things, use of bed pans. The device anchored at the head and foot of the bed, is continuously maintained beneath the patient Because of its waterproof construction, the long term patient's discomfort will be readily apparent.

G C. Kuhn in U.S. Pat. 4,689,842 granted upon application Ser. No. 935,016 filed Nov. 26, 1986 discloses aiding bedridden persons in the use of bed pans and the like by placing the person on a full length platform device with an opening so located that the excreted waste falls directly into the bed pan below the platform. The patient can be moved onto the platform device by the use of a lifting sheet which is attached along one side of the patient motivation device. The platform device is supported above the patient's bed by a series of rigid and resilient supports which work in combination to assist in the placement of the person on the platform device. The bed pans used in this invention can be any of the previously known pans, all of which are characterized by a rigid construction and substantially open top. This construction presents problems in the handling of wastes as well as the cleaning and storing of bed pans.

While the Kuhn bed platform has greatly eased the patient in carrying out their bodily functions there remains a great need for a convenient and aesthetic manner of handling the collected wastes. It is an object of this invention to provide a device for the collection of bodily wastes which eliminates the need to wash bed pans. It is a further object of this invention to provide a system for sanitary and aesthetically acceptable transportation of such wastes. Yet another object is to provide a patient platform which utilizes the waste collector of this invention while avoiding the need to transfer patients for this purpose. Still other objects will be apparent to those skilled in the art upon reference to the following detailed description.

SUMMARY OF THE INVENTION

In accordance with this invention, there is provided a bed pan with a disposable container comprising (a) a support frame having means thereon for engaging and suspending therefrom a disposable container, (b) a disposable, flexible plastic liner having means thereon for mating with said support frame engaging means, and (c) means for releasably maintaining the liner in the frame. The disposable bed pan is particularly useful in connection with the patient motivation device described in the Kuhn patent discussed above or the patient platform set out herein.

DESCRIPTION OF THE DRAWINGS

FIG. 6 is an enlarged partial end view of the patient platform shown in FIG. 5;

FIG. 7 is an enlarged partial end view of a patient motivating device equipped with a patient lifting sheet; and FIG. 8 is a perspective view of a patient motivating device with lifting sheet and having the supports shown in FIG. 7.

DESCRIPTION OF THE PREFERRED EMBODIMENT

Figure 1:
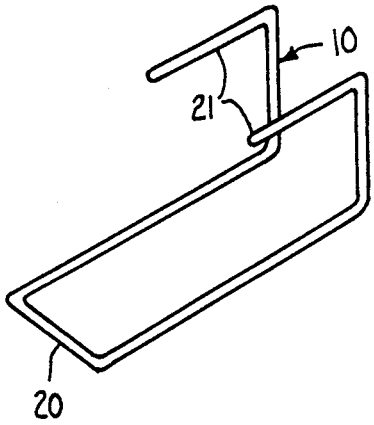
FIG. 1 is a perspective view of an open frame of this invention.
Figure 2:
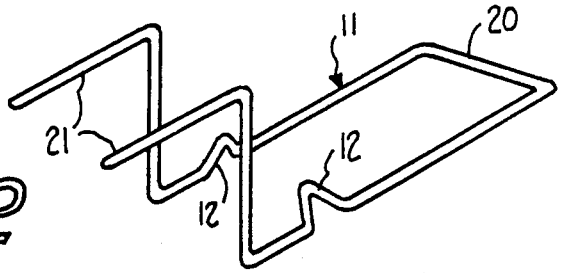
FIG. 2 is a perspective view of an alternate open frame of this invention.
Figure 5:
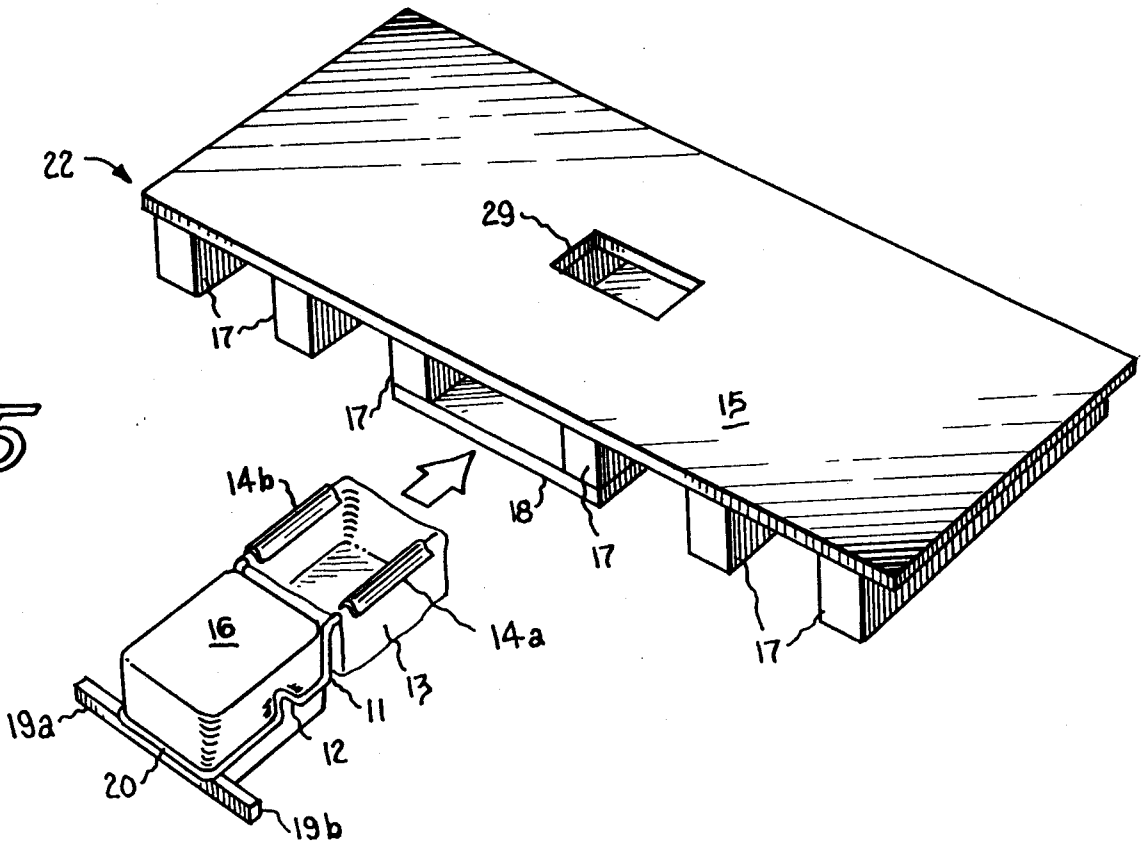
FIG. 5 is a perspective view showing the insertion of the disposable bed pan of FIG. 4 beneath a patient platform of this invention.

Two variations of the structural frame member of the disposable bed pan of this invention are shown in FIGS. 1 and 2. In FIG. 1 the open frame 10 is designed to support, on support arm portion 21, a disposable container for a bed pan (not shown) underneath a patient and provide means, namely a handle section 20 on frame 10, for moving the bed pan into and out of position. In FIG. 2, the second variation of the frame, the support arm portion 21 of frame 11 has been reversed to extend underneath the patient and away from the handle section 20. The frame 11 has been further modified to include cushion retainers 12. The cushion retainers 12 comprises a pair of opposed wedge members which provide a wedging effect to hold a counter weight/patient platform support 16, as best seen in FIG. 5.

Preferably retainers 12 are directed both upwardly and inwardly to enhance the wedging effect.

Figure 3:
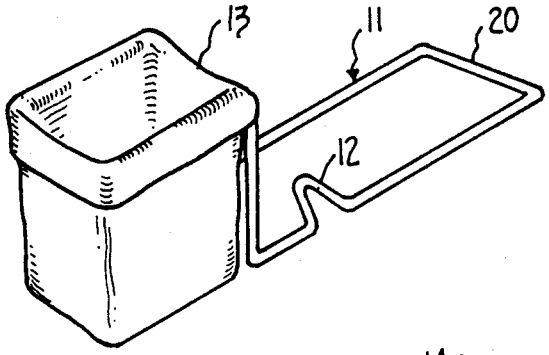
FIG. 3 is a top perspective view of the open frame of FIG. 2 with plastic liner.

FIG. 3 illustrates the placement of a plastic liner 13 on the liner support sections 21 of the frame 11. The liner 13 forms the excrement receiving cavity of the bed pan of this invention. The plastic liner 13 would be placed in a similar position on the open frame 10 variant of frames.

Figure 4:
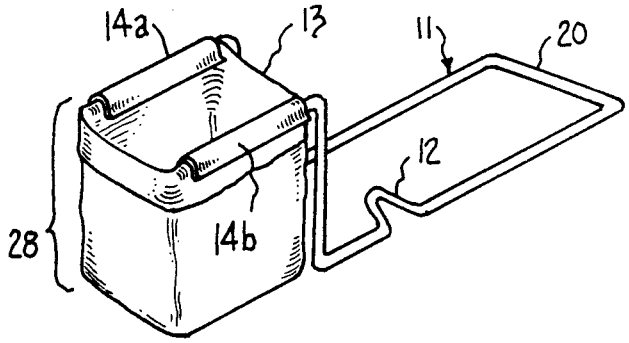
FIG. 4 is a top perspective view of the disposable bed pan of FIG. 3 with retaining clips installed.

The plastic liner 13 may be secured in place on the frame 10 or 11 by the use of retainer clips 14, as shown in FIG. 4. The actual configuration of retainer clips 14 can be varied as desired. The highest degree of disposability of the plastic liner 13 is achieved by the use of retainer clips 14 made of a thin elastomeric plastic or a resilient plastic so that after use of the bed pan the clips 14 are dropped into the plastic liner 13 along with the wastes. Additionally, plastic liner 13 may be modified to provide at the top of the liner 13 and along both of the sides of the liner 13 which are parallel to the support arm portion 21 loops which may be slipped on to the support arm sections 21.

The plastic liner 13 is preferably made of a thin plastic film such as polyethylene or other olefin material. The liner 13 can, for convenience, be formed into a number of useful shapes, e.g., a bag, prior to installation on to the frame 10 or 11. When a clear or translucent plastic is used, measuring marks may be placed on the liner 13 for measuring the amount of patient excrement. For aesthetic reasons, a perfume or fragrance may be incorporated into the plastic liner 13 Similarly, a germicide or bactericide may be incorporated into the liner 13 to enhance sanitation. Additionally the liner 13 may be color coded to identify the wastes from various classes of patients. The particular fragrance, germicide or combination of agents and the like to be used is a matter of choice beyond the scope of this invention but are well known to those skilled in those branches of the arts.

FIG. 5 illustrates the use of the disposable bed pan of this invention in conjunction with a patient platform 22. The patient platform 22 is disclosed in U.S. Pat. No. 4,689,842 as the patient motivation device 25 of FIG. 8 where the resilient supports 27 and the patient lifting sheet 24 function have been removed. Briefly, the platform 22 has a resilient patient support member 15 of size sufficient to fully support a reclining patient. The support member 15 is supported above the bed or similar surface by a plurality of stiff platform supports 17. A communicating opening 29 is formed in member 15 approximately beneath the excretory organs of a patient. This opening communicates with a bed pan, e.g. bed pan 28. Between and underneath the stiff platform supports 17 nearest the opening is a surface protector 18.

The patient platform, or patient motivating device, 25 as shown in FIG. 8 is made up of a patient carrier 15 supported by a series of stiff (that is substantially rigid vertical) carrier supports 17. In use, the patient rests on the upper side of the patient carrier 15 and is so positioned that the patient's excretory openings (anus and urinary) are suspended over the opening 29. The opening 29 forms a communicating passageway between the patient and collector, i.e. bed pan 28. In use, bed pan 28 is positioned under the patient support 15 and between stiff supports 17. Optionally, a surface protector 18 may be installed between supports 17 under the patient support 15 so that the surface on which the patient platform 22 or 25 rests will not be soiled.

In FIG. 8 the communicating opening 29 in patient support 15 to bed pan 28 is shown. Along one side of the patient support 15 and at the end of each stiff support 17 is located a resilient elevating carrier support 27 The stiff supports 17 and resilient supports 27 may be combined into one support with two functions, one on each side, or these supports can be two separate pieces as shown in FIG. 7. The resilient carrier support 27 is so configured as to enhance its resiliency in permitting the patient platform 25 to be depressed to the surface, e.g. of the bed, and to provide anchoring or engagement means for the lifting sheet 24. The lifting sheet 24 functions both as a means of moving the patient 26 from the bed to the patient platform 25 and as a modesty shield for the patient while using the bed pan 28.

The lifting sheet 24 is maintained in place on the patient platform 25 by the attachment at the lower surface of patient carrier 15. This attachment can be of several forms as desired, e.g., tabs on sheet 24 snap fastened to carrier 15, or a zipper substituted for the snaps, or loop tabs on sheet 24 which slide over a rod 21 (or pipe) retained in rod aperture 22 of rigid support 17 as shown in FIG. 7. Appropriate openings 25 are provided in lifting sheet 24 so that it rotates over and around the upper portion 33 of resilient support 27 when the sheet 24 is being used to move the patient onto the platform 25. The lifting sheet 24 when used as a modesty cover is maintained in position over the patient 26 by use of clips 34 or snaps or interlocking fabric closures.

The relationship of stiff supports 17 and resilient supports 27 is more particularly shown by the end view of the patient platform 25 in FIG. 7. As shown, the end of stiff support 17 slopes away from the edge of and underneath patient platform 15. The end of resilient support 27 has a reverse, but complementing slope, with respect to stiff support 17, so that there is a continuous support under carrier 15. Stiff support 17 is permanently affixed to carrier 15 where as resilient support 27 when not an integral part of rigid support 17 may be removably affixed.

In use, when the patient desires to use the bed pan 28, the attendant brings the patient platform 25 to the patient's 26 bed or guerney etc., and positions it along side of and behind the patient. Then the lifting sheet 24, attached to the platform 25, is passed under the patient. The free edge of the lifting sheet 24 is then pulled over to and across the platform 25. As the lifting sheet 24 is pulled, the patient is rolled over to and on to the carrier 15 without lifting by the attendant and positioned over opening 29. The patient is then ready to use the bed pan 28.

As the patient is rolled on to the carrier 15, the force exerted by the patient on the anchored side of the lifting sheet causes the resilient supports 27 to compress and deflect or tilt the carrier 15. When fully deflected, the edge of carrier 15 is substantially at the surface level of the bed, etc. As the patient continues to roll on to the carrier 15, their weight is shifted over to the part supported by the stiff supports 17. This shifting over causes the carrier 15 to pivot or rotate back to its normal level position.

After the bed pan 28 has been used and removed the patient is returned to their original position by the reverse rolling motion. The attendant may reach over the carrier 15 and patient to grip the free edge of the lifting sheet 24 or may be assisted in gripping the lifting sheet 24 by the use of rods hooked into or straps (not shown) attached to the free edge of the lifting sheet 24.

Into the space defined by patient support 15, platform supports 17 and surface protector 18 is inserted a bed pan (comprised of frame 10, 11 beginning with the support arm portion 21, the plastic liner 13 and retainer clips 14 having been previously attached). As previously noted, cushion 16 provides a counterweight to the plastic liner 13 when containing excrement. Cushion 16 also provides further support for the patient support member 15. Finally, as illustrated, cushion 16 has been so configured that it has projections or stop tabs 19 extending sideways from it at the handle portion 20 of frame 11. When frame 11 is fully inserted stop tabs 19 will rest against the end of platform supports 17, thus automatically positioning the plastic liner 13 beneath the opening 29 in patient support member 15 and the patient's excretory organs.

After the plastic liner has been used it is sealed by any of a number of simple sealers such as a wire twist tie, a tape or a bar heat sealer now widely used to seal various flexible plastic containers. The sealed liner 13 is then disposed as desired.

As shown in FIG. 1, frame 10 does not require counter weighting to compensate for the excrement collected in the plastic liner 13. It is with the contemplation of this invention to provide stop tabs similar to stop tabs 19 on cushion 16 to the frame 10, 11 at the handle 20.

The frame 10, 11 can be made of metal or an engineering plastic such as polycarbonate as desired. The material of construction is a matter of choice to those familiar with this brand of the arts. The frame 10, 11 as a minimum size should fully support the plastic liner 13 containing excrement while the maximum size when used in conjunction with a patient motivation device 22 would be that which will allow it to slide between the patient support member 15, sheet protector 18 and platform supports 17. The size can be varied as desired.

The preferred design of the patient platform 25 is to help lift the patient approximately 6 inches (15 cm) above the bed to allow the entrance of a bed pan 28 without a lot of lifting or pressure to the attendant. It is designed to cushion the patient in the downward position and the cushion memory will act like a spring and help in moving the patient six to eight inches (fifteen to twenty cm) above the bed by pulling on the lifting sheet 24 under the patient. The same design configuration is suitable for the patient platform 22.

With the patient lifted six or eight inches (fifteen to twenty cm) above the bed, the bed pan 28 can easily be placed into position or it can be removed from under the patient without any effort on the part of the patient and very little on the part of the person extracting the pan 28.

This method will improve the condition of the patient. They will be in a dry bed and they can be bathed on the patient platform 22 or 25 without having water absorbed in the bed. The water will drain into the pan under the patient.

If the patient suffers from incontinence the patient can be maintained over the bed pan 28 for long periods of time if necessary without discomfort.

The patient platform 22 or 25 can also be utilized when it is necessary to give a patient an enema. The pan 28 will be in place and the patient will not have to have discomfort when the enema is withdrawn.

The clean, simple design of patient platform 22 and 25 provides a number of advantages. To the patient it means not having to lay in an awkward position while using a bed pan, to say nothing of avoiding a cold bed pan. Additionally, the attendant is freed of the hard lifting effort required to simultaneously lift the patient and slide the bed pan underneath. Additional patient comfort can be achieved when the patient receiving surface 23 of the patient platform 22 or 25 is covered with a thin layer of resilient closed cell cellular material. This material may be permanently attached to the platform 22 or 25 if so desired. The patient platforms 22 and 25 are light weight and under ordinary use is very long lasting and easy to store. The materials of construction employed also make the platforms 22 and 25 easy to clean and maintain. Additionally the platform 22 or 25 has sufficient flexibility to compensate for any irregularity in the surface on which it is placed. But, above all it provides a high degree of patient comfort not previously obtainable.

The patient platform 22 or 25 can be constructed of a variety of inexpensive materials as desired. Greater portability, ease of cleaning and greater patient comfort, however, is achieved when a rigid closed cell cellular material is used for the patient carrier 15 and stiff supports 17 plus surface protector 18. These parts can be molded separately and then assembled or molded as a unit by methods well known in the molding art. Additionally, stiff support 17 and resilient support 27 can be made from separate pieces of appropriate materials and with adhesive be permanently joined together or these two parts can be molded in the same step from different materials. In any event the rigid parts can be made from numerous polyurethane, polypropylene, polyethylene, polyvinyl chloride and the like polymeric compositions. Such materials are well known in the art. The thickness of these parts and density of the foam will vary depending upon the physical properties of the polymer and the size of patient to be supported. These parameters are readily understood by those skilled in the design and molding arts.

The resilient carrier support 27 is preferably also made of molded closed cell polymeric foam compositions. It is very desirable that these compositions be characterized by high degree of compressibility and substantially a complete recovery to original shape upon release from compression. These foams are characterized by low densities. A typical trademark for foams of this type is Ethafoam a trademark of Dow Chemical Co.

The communicating opening 29 is shown in FIGS. 5 and 8 as having a rectangular shape However, other shapes may be employed as desired. Additionally, a closing piece or cover may be inserted in the opening 29 when the bed pan is not in actual use. The cover may be made with the same material as the patient support member 15 is made from.

The lifting sheet maybe made from such fabrics as desired. Among the more preferred sheeting materials is tight woven nylon.

The foregoing examples and methods have been described in the foregoing specification for the purpose of illustration and not limitation. Many modifications and ramifications will naturally suggest themselves to those skilled in the art based on this disclosure. These are intended to be comprehended as within the scope of this invention.

The embodiments of the invention in which as exclusive property of privilege is claimed are defined as follows:

1. A bed pan with a disposable container comprising:
(a) an open support frame having mean thereon for engaging and supporting therefrom a disposable container,
(b) a disposable flexible container having means for mating with said support frame engaging means, and
(c) means for releasably maintaining said disposable container on said frame, said frame having a generally oblong or U shaped base member, there being attached to each of the two ends of base member an end of an upright post member extending outwardly from said base member, the other end of each of said post member having a support arm, for engaging with said container, extending outwardly substantially perpendicularly from said popst, said support arms being parallel to and opposite each other, the said post members being of such length that when said container is engaged with said support arms said base member extends outwardly from said container near the bottom of said container, said base member having a portion thereof adapted to be a positioning handle.

2. The bed pan of claim 1 wherein said disposable container is shaped like a bag.

3. The bed pan of claim 2 where in said frame base member extends outwardly away from said container and said support arm and said base member includes means for retaining and holding a counterweight.

4. The bed pan of claim 3 wherein a cushion counterweight is contained with the frame of said bed pan.

5. The bed pan of claim 4 wherein said cushion has one or more stop tabs adjacent to said handle portion of said frame.

6. A device for assisting bedridden patients in their excretory functions comprising:
(1) a substantially rigid rectangular platform for supporting and engaging the entire body of a patient in a substantially horizontal position thereon, said platform including a communicating opening therein so located that waste excreted by said patient falls into a waste collector underneath said opening without touching said platform, and
(2) a plurality of substantially rigid vertical supports formed on the underside of said platform and transversely spaced the length of said platform for supporting in a fixed position said platform at a predetermined distance above the surface on which said patient is reposed.

* * * * *